US008683617B2

(12) United States Patent
Chilson et al.

(10) Patent No.: US 8,683,617 B2
(45) Date of Patent: Apr. 1, 2014

(54) MULTI-COMPONENT HELMET WITH VENTILATION SHUTTER

(75) Inventors: James A. Chilson, Hailey, ID (US); Hans Lindauer, Portland, OR (US)

(73) Assignee: Smith Optics, Inc., Ketchum, ID (US)

( * ) Notice: Subject to any disclaimer, the term of this patent is extended or adjusted under 35 U.S.C. 154(b) by 474 days.

(21) Appl. No.: 13/009,796

(22) Filed: Jan. 19, 2011

(65) Prior Publication Data

US 2012/0180199 A1 Jul. 19, 2012

(51) Int. Cl.
*A42B 1/20* (2006.01)

(52) U.S. Cl.
USPC ..... 2/171.1; 2/410; 2/411; 2/424; 2/425; 2/438; 2/171.3

(58) Field of Classification Search
USPC ..... 2/410, 411, 412, 422, 424, 425, 171.3, 2/184.5; 3/410, 411, 412, 422, 424, 425, 3/171.3, 184.5
See application file for complete search history.

(56) References Cited

U.S. PATENT DOCUMENTS

| | | | |
|---|---|---|---|
| 640,418 | A | 1/1900 | Royer |
| 5,701,610 | A | 12/1997 | Hsu |
| D414,585 | S | 9/1999 | Ho |
| D445,219 | S | 7/2001 | Ho |
| D447,288 | S | 8/2001 | Ho |
| D452,941 | S | 1/2002 | Ho |
| D452,942 | S | 1/2002 | Ho |
| D453,056 | S | 1/2002 | Garneau |
| D455,522 | S | 4/2002 | Royes et al. |
| 6,446,271 | B1 | 9/2002 | Ho |
| D464,468 | S | 10/2002 | Ho |
| D481,171 | S | 10/2003 | Ho |
| 7,111,329 | B2 | 9/2006 | Stroud et al. |
| D549,394 | S | 8/2007 | Broeckl |
| D628,346 | S | 11/2010 | Petzl |
| 7,975,320 | B2 | 7/2011 | Muskovitz et al. |
| D654,628 | S | 2/2012 | Aris et al. |
| 2004/0158914 | A1 | 8/2004 | Tanaka |
| 2004/0250339 | A1 | 12/2004 | Musal |
| 2005/0283885 | A1 | 12/2005 | Stroud et al. |
| 2006/0059606 | A1 | 3/2006 | Ferrara |
| 2007/0130672 | A1 | 6/2007 | Beddoe et al. |

(Continued)

OTHER PUBLICATIONS

International Search Report and Written Opinion dated May 17, 2012 for International Application No. PCT/US2011/055904, May 17, 2012, 1-8.

*Primary Examiner* — Danny Worrell
*Assistant Examiner* — Khaled Annis
(74) *Attorney, Agent, or Firm* — Dorsey & Whitney LLP

(57) ABSTRACT

Helmets and methods for manufacturing a helmet are described. An example helmet includes an upper helmet component having a shell and a shock absorbing liner and further having a lower helmet component having a shell and a shock absorbing liner. The shock absorbing liner of the lower helmet component has an angled interface portion to which the upper helmet component is attached. A vent sill is attached to the shock absorbing liner of the upper helmet component and a vent shutter is slidably attached to the vent sill. An example method include forming a first in-mold component having a shell and shock absorbing liner and forming a second in-mold component having a shell and shock absorbing liner, the shock absorbing liner having a seamless headform. After a vent shutter assembly is attached to the first in-mold component the second in-mold component is attached to the first in-mold component.

28 Claims, 8 Drawing Sheets

(56) References Cited

U.S. PATENT DOCUMENTS

2007/0136932 A1 6/2007 Muskovitz et al.
2008/0172775 A1* 7/2008 Higgins ..... 2/422
2008/0295228 A1 12/2008 Muskovitz
2011/0167541 A1 7/2011 Chilson

* cited by examiner

MULTI-COMPONENT HELMET WITH VENTILATION SHUTTER

TECHNICAL FIELD

Embodiments of the invention relate generally to helmets, and more specifically in one or more of the illustrated embodiments, to helmets for outdoor activities.

BACKGROUND OF THE INVENTION

Helmets are used in many outdoor activities to protect the wearer from head injuries that may occur during the activity. For example, helmets worn during snow sports provide head protection to a the wearer in the event of a fall or crash, as well as from equipment (e.g., skis, poles, snowboards, boots) that may come loose and strike the wearer in the head. In another example, cycling helmets protect the rider's head in the event of a fall or crash which may subject their head to impact.

Consumers measure the desirability of a helmet based on various criteria. For example, helmets should provide good protection to the head in the event of an impact, but should also be relatively light in weight and provide sufficient ventilation when worn. Helmets should also be affordable and have a design that facilitates manufacturability. Additionally, a helmet should be esthetically pleasing or consumers will not purchase it.

Often, these various criteria compete with one another. For example, a helmet that is light in weight and provides adequate ventilation is generally less impact resistant than one that has a heavier design. That is, a helmet can be designed with a harder shell material that is generally heavier than other lighter shell materials resulting in a helmet that provides greater protection but is not as light as desirable. A helmet may be designed to have less ventilation openings to improve coverage of the head in the event of an impact, but this results in a helmet having less ventilation than is desirable. Additionally, a helmet providing good head protection and is light in weight may be complicated to manufacture and can be expensive.

Therefore, there is a need for alternative helmet designs that can balance various competing factors that are used in measuring the desirability of a helmet.

DETAILED DESCRIPTION

The present invention is generally directed to a helmet formed from multiple helmet components and having a ventilation shutter assembly. Many of the specific details of certain embodiments of the invention are presented in the following description and in FIGS. 1-5 to provide a thorough understanding of such embodiments. One skilled in the art will understand, however, that the present invention may have additional embodiments, or that the present invention may be practiced without several of the details described in the following description.

Figure 1A:
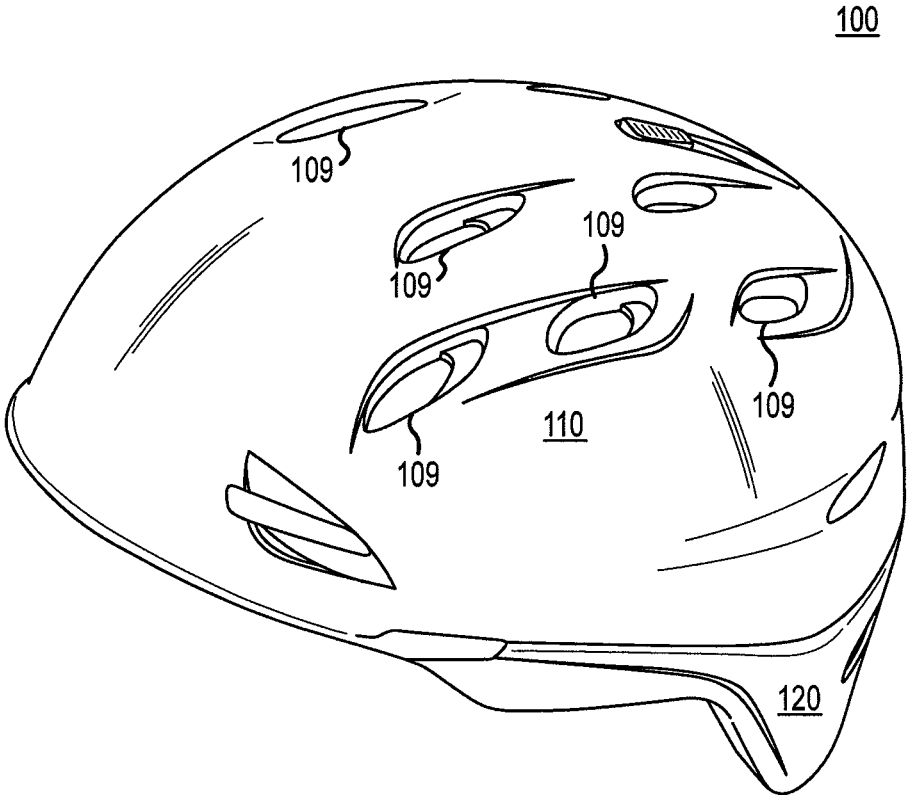
FIGS. 1A and 1B are perspective drawings of a helmet according to an embodiment of the invention.
Figure 1B:
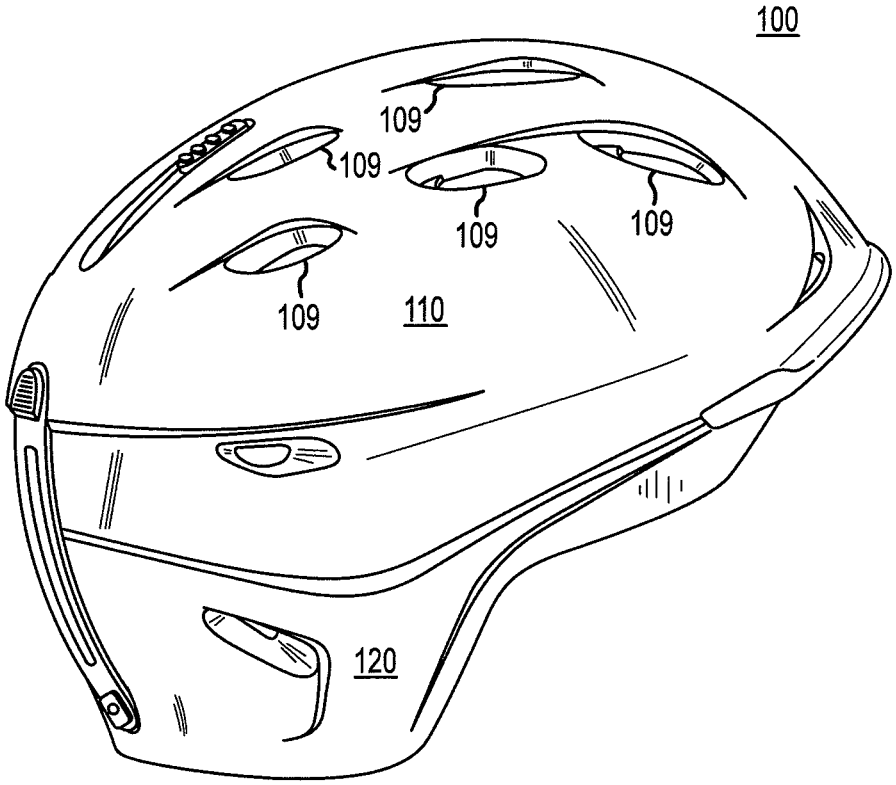

FIGS. 1A and 1B illustrate a helmet 100 according to an embodiment of the invention. The helmet 100 includes an upper helmet component 110 having openings 109 to provide ventilation to the wearer. The upper helmet component 110 is attached to a lower helmet component 120. The lower helmet component 120 has openings that generally corresponding to the openings 109 of the upper helmet component 110. In the embodiment illustrated in FIGS. 1A and 1B, the upper helmet component 110 generally forms a "cap" that covers and is attached to the lower helmet component 120.

Figure 2A:
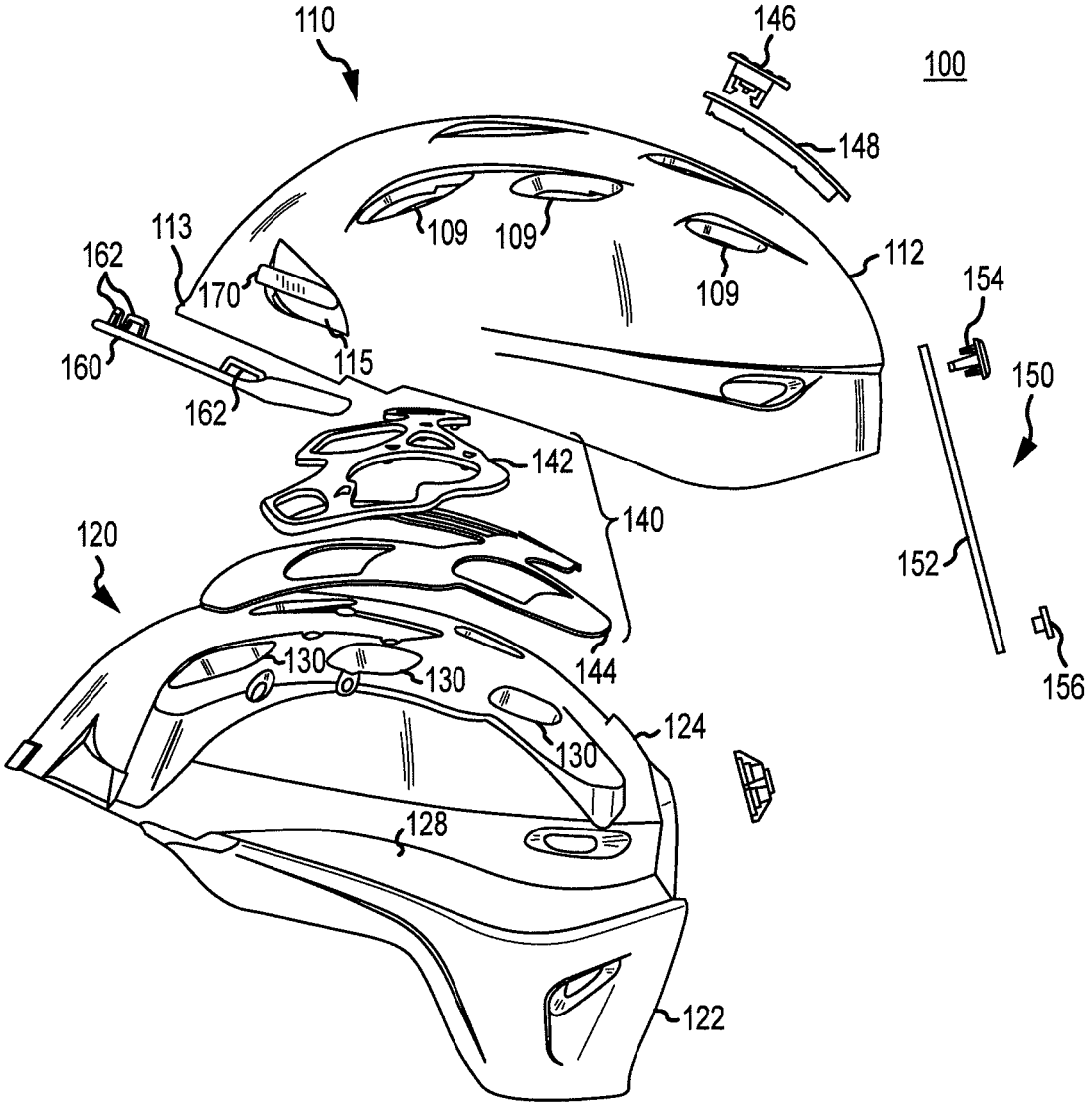
FIGS. 2A and 2B are exploded perspective drawings of the helmet of FIGS. 1A and 1B.
Figure 2B:
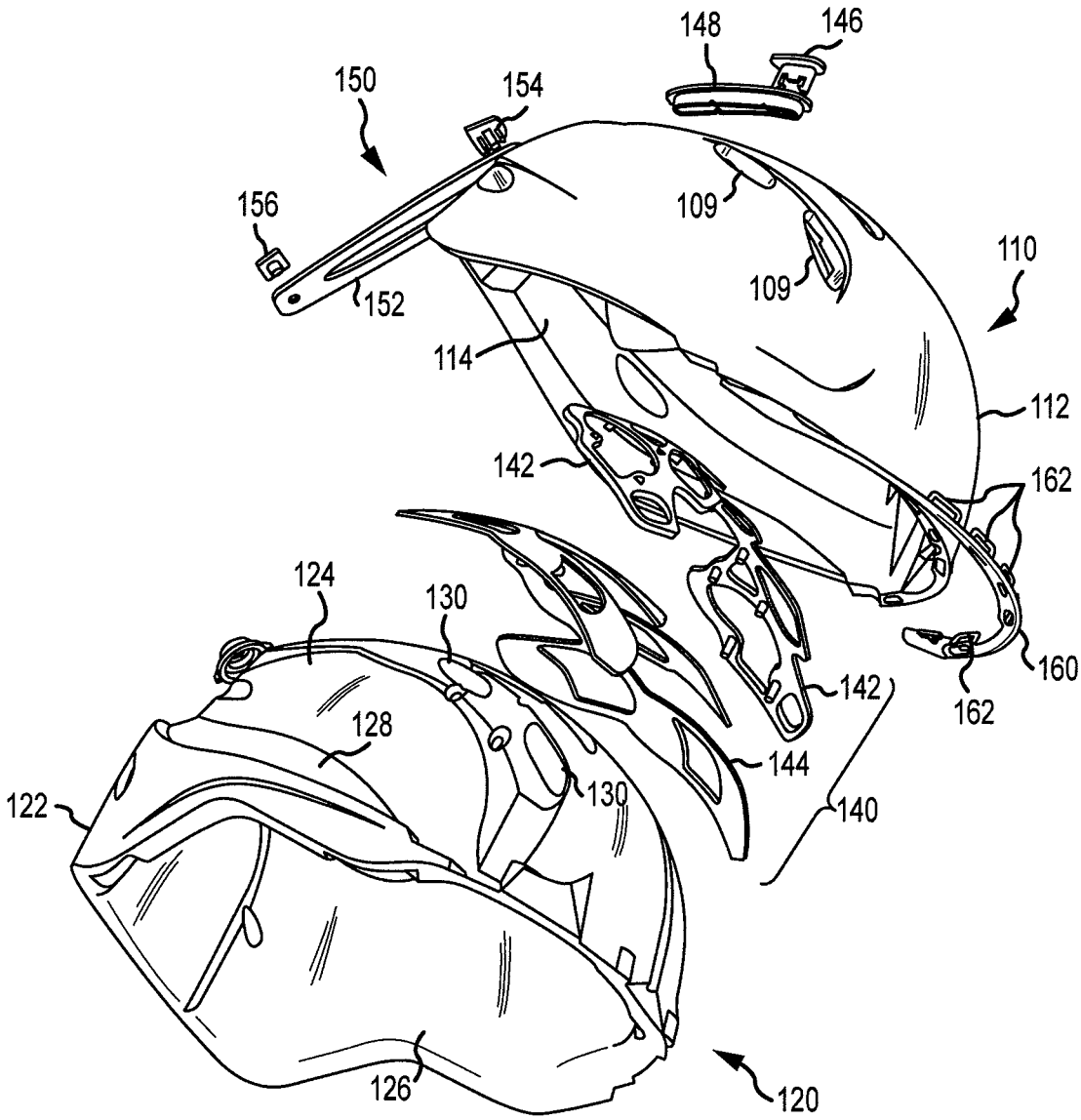

As illustrated in FIGS. 2A and 2B, the upper helmet component 110 includes a shell 112 and a shock absorbing liner 114 bonded to the shell 112. The shell 112 generally forms a bowl shape in which the shock absorbing liner 114 lines resulting in a concave cap. The lower helmet component 120 includes a shell 122 and a shock absorbing liner 124 bonded to the shell 122. The shell 122 generally forms an open ring shape that is bonded to the shock absorbing liner 124 that generally forms a bowl shape having an concave portion that is configured to receive a wearer's head. As will be described in more detail below, a convex portion of the bowl of the lower helmet component 120 is capped by the upper helmet component 110.

The shock absorbing liner 124 may be formed to have a headform surface 126 that is at least substantially seamless. For example, the headform surface 126 is not interrupted by joints or seams that may compromise the shock absorbing capabilities and/or the structural integrity of the shock absorbing liner 124 during impact of the helmet 100. That is, forming the shock absorbing liner 124 to have a headform surface 126 that is seamless may result in greater structural strength than a headform surface that includes seams between different portions of the liner 124. Although a seamed shock absorbing liner 124 may be less desirable than one having a seamless headform surface, such a construction is within the scope of the present invention.

The lower helmet component 120 includes a interface surface 128. As illustrated in FIGS. 2A and 2B, the interface surface 128 may be formed on the shock absorbing liner 124 and generally positioned at the perimeter of the shell portion 122, and as will be described in more detail below, includes a surface to which the upper helmet component 110 may be attached to the lower helmet component 120. The upper helmet component 110 may be attached to the lower helmet component 120 at the interface surface 128 using adhesive materials, bonding techniques, or other attachment techniques currently known or later developed. The attachment technique can include the use of tabs and slots formed in the upper and lower helmet components, as well as snap clips or snap buttons as well.

The shells 112, 122 may be formed from polycarbonate (PC), Acrylonitrile butadiene styrene (ABS) or other suitable material for use in an in-mold manufacturing process. The shock absorbing liners 114, 124 may be formed from various materials, for example, expanded polystyrene (EPS) material, expanded polypropylene (EPP) material, or other suitable shock absorbing materials. In some embodiments, the upper and lower helmet components 110, 120 are formed using conventional in-mold technology currently known in the art, or later developed. For example, the shells 112, 122 may be formed by injection molding techniques, or from a PC flat sheet which is first thermally formed and then installed in the final EPS mold to heat bond with the final foam shape. As known, the shells are not post installed, but insert molded. The upper and lower helmet components 110, 120 may be formed from other materials and/or using other manufacturing techniques as well. Thus the present invention is not limited to the particular materials previously described or made using an in-mold process.

The helmet 100 further includes a ventilation shutter assembly 140. The ventilation shutter assembly 140 is attached to the upper helmet component 110 and provides control over the portion of the openings 109 that allow air to flow to the interior of the helmet 100. The ventilation shutter assembly 140 includes a vent sill 142 and a vent shutter 144. The vent shutter assembly 140 may be attached to a vent button 146 positioned in a vent button track 148. The vent button track 148 is positioned in an opening through the shell 112 and the shock absorbing liner 114 and the vent button 146 is attached to the vent shutter 144 to provide a mechanism for sliding the vent shutter 144, thereby changing the portion of the openings 109 through which air may flow.

The upper helmet component 110 is configured so that the shell 112 provides substantially full coverage for the shock absorbing liner 114. The shell 122 of the lower helmet component 120 is configured to substantially cover at least a portion of the shock absorbing liner 124 not covered by the upper helmet component 110. As a result, the shock absorbing liners 114, 124 are substantially covered (i.e., by either the shell 112 or the shell 122, or overlapping shells 112, 122) for an assembled helmet 100. Thus, the portion of the shock absorbing liners 114, 124 exposed on an exterior surface of an assembled helmet may be reduced, which may provide cosmetic and structural benefits.

The helmet may include helmet strap loops (not shown) attached to lower helmet component 120 to which helmet straps may be attached. The helmet strap loops may be attached to the shock absorbing liner 124, for example, by having a portion embedded in the shock absorbing liner 124. Other attachment techniques may be used as well, for example, adhesive or bonding techniques may be used as well.

The helmet 100 may optionally include a goggle strap retainer 150 which may be used to retain a strap of a pair of goggles to the helmet 100. The goggle strap retainer 150 may be positioned at a rear portion of the helmet and include a retainer portion 152 attached to the upper helmet component 110 using a snap plug 154 and attached to the lower helmet component 120 using a snap plug 156. Other configurations of a goggle strap retainer 150 may be optionally included as well, for example, a clip-type goggle strap retainer, in addition to other retainer systems, may also be used.

A brim guard 160 may be optionally included with the helmet 100. The brimguard 160 may be attached to the upper helmet component 110, or alternatively, integrally formed with the upper helmet component 110. The brimguard 160, as illustrated by FIGS. 2A and 2B, may include clips 162 for attaching the brimguard 160 to the upper helmet component 110. An example brimguard that may be suitable is described in U.S. patent application Ser. No. 12/687,830, filed on Jan. 14, 2010, which is incorporated herein, in its entirety, for any purpose. The brimguard 160 may be formed from a material sufficiently durable and/or resilient to provide protection to a front portion 113 of the helmet 100.

The helmet may also optionally include decorative badge 170 attached to the upper helmet component 110, for example. The upper helmet component 110 may include recesses 115 located proximate the front portion 113, as illustrated in FIGS. 2A and 2B, in which the decorative badges 170 are positioned, thereby allowing the decorative badges 170 to be substantially uniform with the contour of the upper helmet component 110.

Figure 3A:
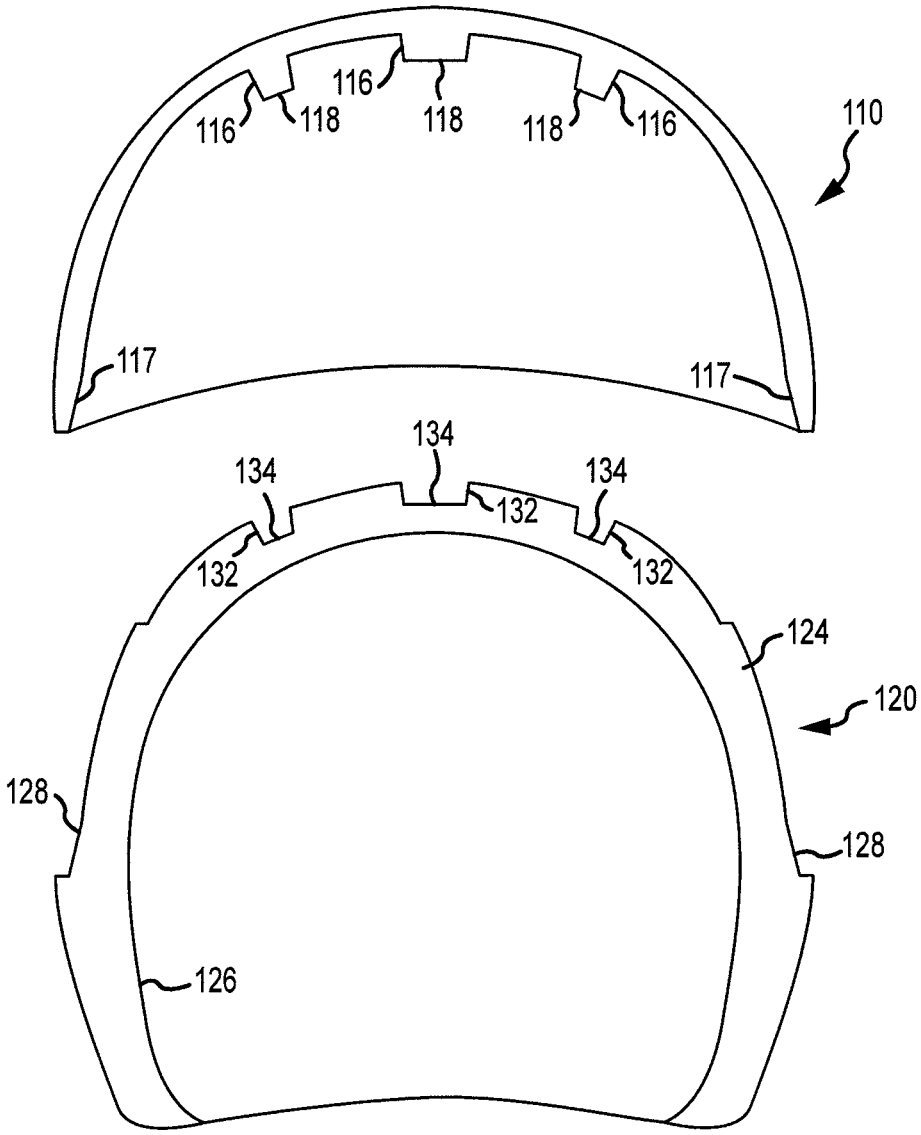
FIG. 3A is an exploded cross-sectional drawing of the helmet according to an embodiment of the invention.
Figure 3B:
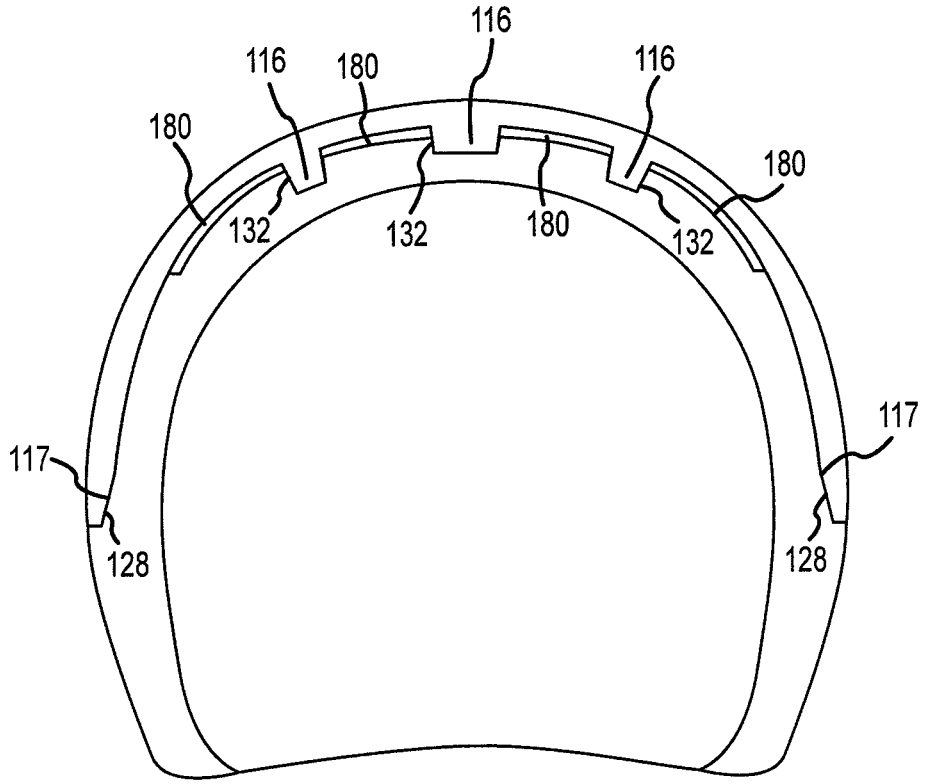
FIG. 3B is a cross-sectional drawing of a helmet of FIG. 3A.

FIGS. 3A and 3B illustrate a cross-sectional view of the helmet 100. The shock absorbing liner 124 of the lower helmet component 120 may be formed to include channels 132 that are configured to receive ridges 116 formed in the shock absorbing liner 114 of the upper helmet component 110. The ridges 116 may be integrally formed in the shock absorbing liner 124. The channels 132 and the ridges 116 run fore and aft directions of the helmet 100. Cavities 180 formed by the ridges 116 and the channels 132 allow the vent shutter 144 to slide when moved. The ridges 116 may have a bearing surface 118 that may contact channel surface 134 to provide structural support between the upper and lower helmet components 110, 120, for example, in the event of an impact proximate the crown or upper portion of the helmet 100. Moreover, a configuration as illustrated in FIGS. 3A and 3B may allow the shock absorbing liners 114 and 124 to be formed having portions that are substantially continuous across the helmet (i.e., parallel to the section view of FIGS. 3A and 3B) and without large cavities for further impact absorption. In some embodiments, the bearing surface 118 provides a surface that may be used to attach the upper helmet component 110 to the lower helmet component 120, for example, by using adhesive or other bonding or adhering technique.

FIGS. 3A and 3B further illustrate the interface surface 128 of the lower helmet component 120. As illustrated in FIGS. 3A and 3B, the interface surface 128 may be formed with an angled profile. The angled profile may provide a surface on the second shock absorbing liner 124 having an increasing circumferential dimension around a coronal region of the helmet 100. The interface surface 128 may wrap around from a side portion of the helmet 100 to a rear portion, and around to the other side. The interface surface 128 may be continuous, or in some embodiments, may include spaced apart sections along the coronal region of the helmet 100. An interface surface 117 of the shock absorbing liner 114 may be formed with an angled profile that corresponds to the angled profile of interface surface 128 and may provide a surface near the coronal region of the helmet 100 to attach the upper helmet component 110 to the lower helmet component 120. The angled profiles of the interface surfaces 117, 128 may also facilitate a tight fit between the upper and lower helmet components 110, 120, for example, to accommodate manufacturing tolerances, during assembly of the helmet 100. The angled profile of the interface surfaces 117, 128 may also provide a reinforced seam between the upper and lower helmet components 110, 120 that is resistant to breakage in the event of a sharp edge or blunt impact near the seam (e.g., near the coronal region of the helmet 100). That is, the increased thickness of the second shock absorbing liner 124 near the base of the angled profile may provide resistance to breakage due to an impact proximate the seam as compared to an interface surface 128 that does not have an angled profile.

Figure 4:
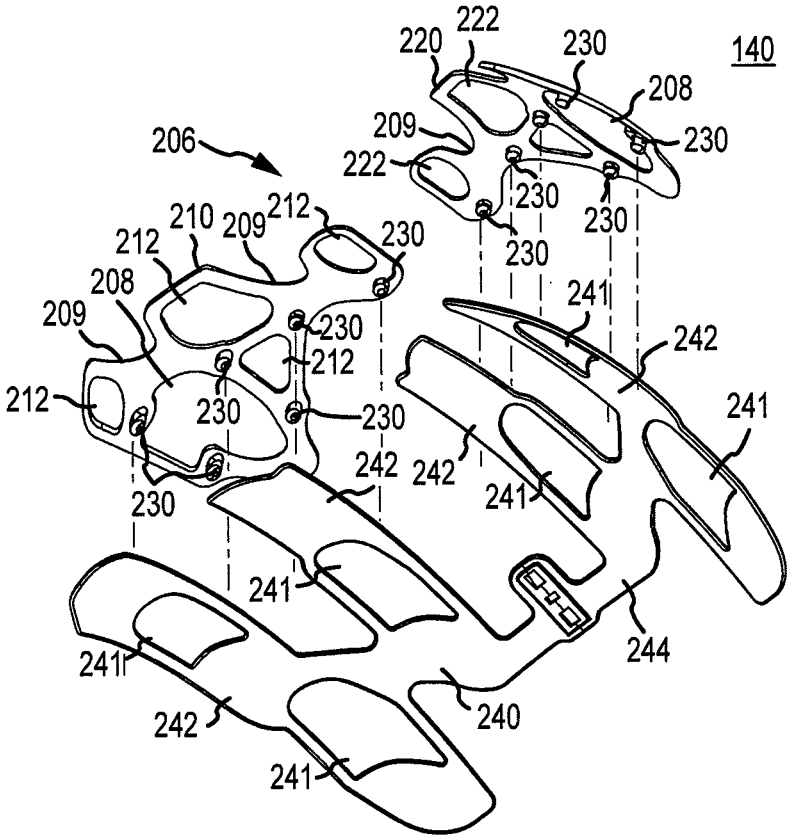
FIG. 4 is an exploded perspective drawing of a shutter assembly according to an embodiment of the invention.

FIG. 4 illustrate the ventilation shutter assembly 140 according to an embodiment of the invention. A vent sill 206 includes first and second sills 210, 220 that may be attached to the upper helmet component 110. The first and second sills 210, 220 are formed with guides 230 to which a vent shutter 240 is slid ably attached. The guides 230 guide the movement of the vent shutter 240 as it is moved relative to the vent sill 206. The guides 230 in the embodiment of FIG. 3 are illustrated as slotted protrusions which engage vent shutter 240 and limit lateral movement of the vent shutter 240 while it is moved.

The vent sill 206 is formed having openings 208 that when attached to the upper helmet component 110 generally correspond to the openings 109 of the upper helmet component 110. Portions 209 of the vent sill 206 may overlap one or more of the openings 109. In some embodiments, the vent sill 206 may be used to reinforce the openings 109 by providing additional structural rigidity around the openings 109. For example, the vent sill 206 may be formed from a relatively rigid material and may be positioned relative to the openings 109 so that portions of the vent sill 206 may be adjacent to openings 109 or may overlap a portion of the openings 109. The vent sill 206 provides a surface on which the vent shutter 240 may slide that is more resistant to wear than the material of the shock absorbing liner 114. That is, sliding of a vent shutter directly touching the shock absorbing liner 114 may cause wear, which over time may decrease the fit between the vent shutter and shock absorbing liner. The decreased fit may allow the vent shutter to vibrate, for example, when air is flowing over the helmet 100.

In the embodiment of the ventilation shutter assembly 140 illustrated in FIG. 4, the vent shutter 240 includes blades 242 in which openings 241 are formed. The blades 242 extend from a connecting portion 244 to which a vent button may be attached. As previously described, the vent button may be used to slide the vent shutter 240 to various positions. The openings 241 are positioned on the blades 242 such that sliding the vent shutter 240 as guided by guides 230 provides control over air flow through the openings 109 of the upper helmet component 110. For example, at a first example position, portions of the blades 242 where the openings 241 are not present are positioned to completely block any air flow through openings 109. At a second example position, the blades 242 are positioned such that a portion of the openings 241 overlap the openings 109 to allow some air to flow through the openings 109. At a third example position, the blades 242 are positioned such that the openings 241 substantially correspond to the openings 109 to allow a maximum air flow through the openings 109. The vent shutter 240 and the vent sill 206 may formed with indexed portions (not shown) to provide indexing to the opening and closing of the vent shutter 240. In some embodiments, the vent shutter 240 and the vent sill 206 are configured to provide continuous adjustment of the position of the vent shutter 240.

Figure 5:
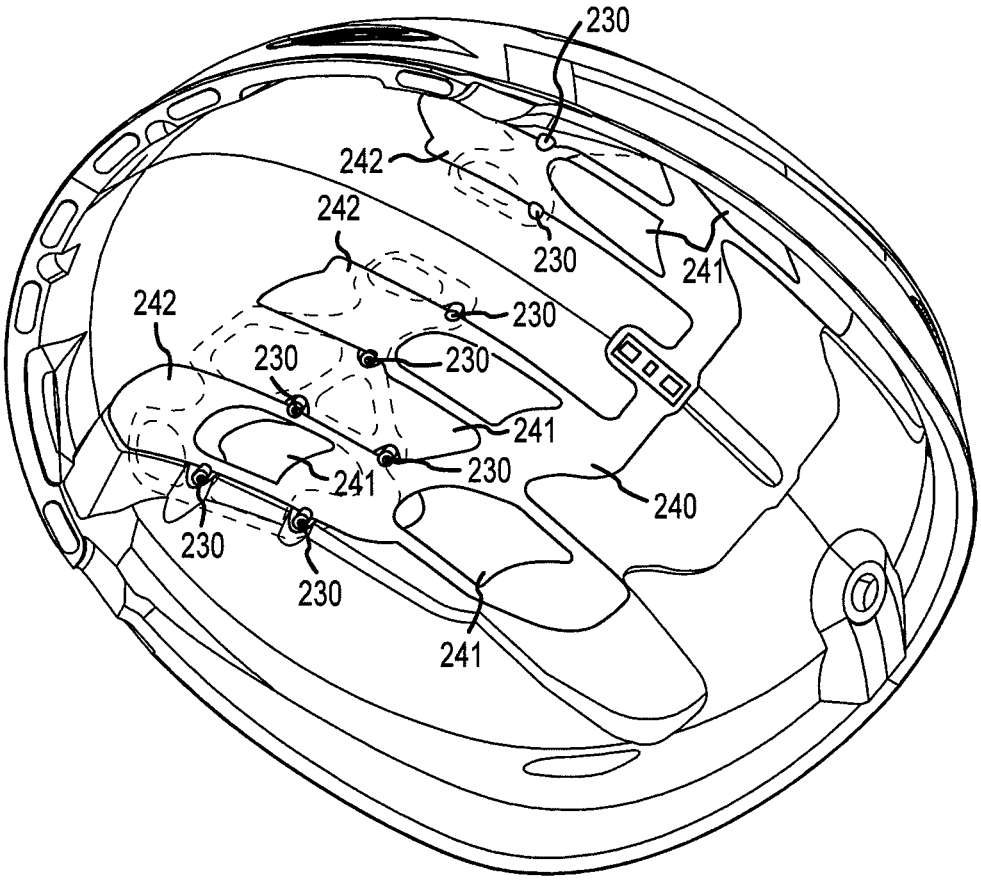
FIG. 5 is a perspective drawing of the shutter assembly of FIG. 4 according to an embodiment of the invention attached to an upper helmet component.

As previously described, the ventilation shutter assembly 140 may be attached to the upper helmet component 110. The first and second sills 210, 220 of the vent sill 206 may be attached to the shock absorbing liner 114. For example, the vent sill 206 may be attached to the shock absorbing liner 114 during formation of the upper helmet component 110. For example, the first and second sills 210, 220 include openings 212, 222 through which the material of the shock absorbing liner 114 may be applied during formation such that the first and second sills 210, 220 are affixed to the concave portion of the underside of the upper helmet component 110, for example, at least in part due to the rigidity of the finally formed shock absorbing liner 114. The vent shutter 240 engages the guides 230 and may be moved fore and aft to open or close the openings 109 of the upper helmet component 110. FIG. 5 illustrates the ventilation shutter assembly 140 attached and in place in the upper helmet component 110. The lower helmet component 120 (not shown in FIG. 5) is attached to the upper helmet component 110 after the shutter assembly 140 is attached. As previously discussed, the lower helmet component 120 may be attached using conventional attachment techniques.

The above description of illustrated embodiments of the invention is not intended to be exhaustive or to limit the invention to the precise form disclosed. While specific embodiments of, and examples of, the invention are described in the foregoing for illustrative purposes, various equivalent modifications are possible within the scope of the invention, as those skilled in the relevant art will realize. Moreover, the various embodiments described above can be combined to provide further embodiments. Accordingly, the invention is not limited by the disclosure, but instead the scope of the invention is to be determined entirely by the following claims.

What is claimed is:

1. A helmet, comprising:

a first helmet component including a first shell and a first shock absorbing liner attached to the first shell, the first helmet component having a convex bowl portion;

a second helmet component attached to the first helmet component, the second helmet component including a second shell and a second shock absorbing liner attached to the second shell, the second shell a separate shell from the first shell, and the second shock absorbing liner having a seamless headform and further having a portion substantially covered by the first helmet component; and a ventilation shutter assembly disposed between the first shell and the second shock absorbing liner, the ventilation shutter assembly including a vent sill attached to the first helmet component and further including a vent shutter slidably engaged with the vent sill.

2. The helmet of claim 1 wherein the first helmet component includes first openings and wherein the second helmet component includes second openings positioned relative to the first openings to provide ventilation, the ventilation shutter assembly configured to control at least in part ventilation through the first and second openings.

3. The helmet of claim 1 wherein the vent sill is attached to the first helmet component using the first shock absorbing liner of the first helmet component.

4. The helmet of claim 1 wherein the second shock absorbing liner includes an interface surface to which the first helmet portion is attached, the interface surface disposed adjacent to a perimeter of the second shell.

5. The helmet of claim 4 wherein the interface surface slopes from the perimeter of the second shell toward the second shock absorbing liner to provide a tight fit between the first and second helmet portions.

6. The helmet of claim 4 wherein the interface surface is formed having an angled profile.

7. The helmet of claim 6 wherein the first shock absorbing liner includes a surface having an angled profile corresponding to the angled profile of the interface surface.

8. The helmet of claim 4 wherein the interface surface is configured to provide a reinforced seam between the first and second helmet portions.

9. The helmet of claim 1 wherein the vent sill of the ventilation shutter assembly is insert molded with the first shock absorbing liner of the first helmet component.

10. The helmet of claim 1 wherein the vent sill of the ventilation shutter is configured to reinforce the first helmet component.

11. The helmet of claim 1 wherein the vent sill comprises first and second components, each having openings corresponding to ventilation openings of the first helmet component.

12. The helmet of claim 1 wherein the vent sill includes guides to which the vent shutter slidably engages.

13. The helmet of claim 12 wherein the guides comprise slotted protrusions configured to engage the vent shutter and limit lateral movement of the vent shutter during movement of the vent shutter.

14. The helmet of claim 1 wherein the vent sill is attached to the first shell between the first shock absorbing liner and the first shell.

15. A helmet, comprising:

an upper helmet component having a first shell and a first shock absorbing liner attached to the shell;

a vent sill affixed to an underside of the first shell using the first shock absorbing liner of the upper helmet component;

a vent shutter slidably attached to the vent sill; and a lower helmet component having a second shell and a second shock absorbing liner attached to the second shell, the second shock absorbing liner of the lower helmet component having an angled interface portion to which the upper helmet component is attached, the second shell a separate shell from the first shell.

16. The helmet of claim 15 wherein the upper helmet component comprises a polycarbonate shell and an expanded polystyrene shock absorbing liner.

17. The helmet of claim 15 wherein the first shell is in-molded with the first shock absorbing liner.

18. The helmet of claim 15 wherein the angled interface portion is proximate a coronal region of the helmet.

19. The helmet of claim 15 wherein the shock absorbing liner of the lower helmet component includes channels and the shock absorbing liner of the upper helmet component includes ridges configured to fit within the channels.

20. The helmet of claim 19 wherein the channels extend fore and aft of the helmet.

21. The helmet of claim 19 wherein the ridges and channels form cavities therebetween, the vent shutter having at least a portion positioned in the cavities.

22. The helmet of claim 15, further comprising a vent switch button and a vent button track disposed in an opening in the upper helmet component, the vent switch button attached to the vent shutter and positioned in the vent button track.

23. The helmet of claim 15, further comprising a brimguard attached to at least one of the upper and lower helmet components.

24. The helmet of claim 15, further comprising a goggle strap retainer attached to the upper helmet component.

25. The helmet of claim 15 wherein the shell of the upper helmet component substantially covers the shock absorbing liner of the upper helmet component.

26. The helmet of claim 15 wherein the shell of the lower helmet component is configured as an open ring wrapped around the lower helmet component from a side of the helmet around a rear portion and to the other side of the helmet.

27. The helmet of claim 15 wherein the shells of the upper and lower helmet components are configured to provide substantially full exterior coverage of the first and second shock absorbing liners.

28. The helmet of claim 15 wherein the upper helmet component is bowl shaped having a concave portion and the lower helmet component is bowl shaped having a convex portion configured to fit in the concave portion and further configured to be covered by the upper helmet component.

* * * * *